US005526943A

United States Patent [19]

Thompson

[11] Patent Number: 5,526,943

[45] Date of Patent: Jun. 18, 1996

[54] STORAGE RACK

[76] Inventor: Dexter G. Thompson, 1438 Larkfield La., Charlotte, N.C. 28210

[21] Appl. No.: 235,868

[22] Filed: May 2, 1994

[51] Int. Cl.[6] ..... A47F 7/00

[52] U.S. Cl. ..... 211/87; 211/13; 211/50; 211/90; D6/524

[58] Field of Search ..... 211/87, 88, 90, 211/149, 71, 13, 50; D6/524, 527

[56] References Cited

U.S. PATENT DOCUMENTS

| | | | |
|---|---|---|---|
| D. 191,924 | 12/1961 | Meade . | |
| D. 326,974 | 6/1992 | Grassie | D6/524 |
| 559,744 | 5/1896 | Price | 211/88 X |
| 577,204 | 2/1897 | Patten | 211/88 X |
| 1,274,172 | 7/1918 | Lee | 211/88 X |
| 2,817,566 | 12/1957 | Herman | 211/88 |
| 3,342,343 | 9/1967 | Youlden | 211/88 |
| 3,684,102 | 8/1972 | Colter | 211/ 88 |
| 4,040,522 | 8/1977 | Vickery | 211/88 |
| 4,936,470 | 6/1990 | Prindle | 211/88 X |
| 5,337,906 | 8/1994 | Digiulio | 211/88 |

*Primary Examiner*—Robert W. Gibson, Jr.
*Attorney, Agent, or Firm*—Clifton Ted Hunt

[57] ABSTRACT

This invention relates to a toilet accessory comprising a storage rack particularly adapted for use in the toilet stalls of public rest rooms and in the bathrooms of homes. The storage rack has shelves for holding personal items and books, compartments for temporarily holding magazines, file folders, and the like, and a newspaper holder. The rack may also include amenities for successive users of the toilet stall or bathroom, such as note paper and pen, a drop-down table, a removable mirror, and toilet paper.

8 Claims, 7 Drawing Sheets

STORAGE RACK

FIELD OF THE INVENTION

This invention relates to a toilet accessory comprising a storage rack for the temporary storage of personal items in bathrooms and public rest rooms.

BACKGROUND OF THE INVENTION

The toilet stalls in public rest rooms are conventionally cramped and offer little, if any, space for the storage of personal items such as reading material and the like. Bathrooms in many homes have a similar disadvantage.

SUMMARY OF THE INVENTION

A rack equipped for the temporary storage of personal items is attached to the inside of the door of a toilet stall in a public restroom or to the wall of a bathroom in a home. The rack is equipped with shelves for books and personal items, compartments for magazines, portfolios and file folders, and a newspaper holder. The provision of brackets or pockets for notepaper, a removable mirror, an emery board, nail clippers, and an attached pen are also disclosed.

A second embodiment of the invention includes a drop-down table, and a third embodiment includes a toilet paper holder.

DETAILED DESCRIPTION OF THE INVENTION

Figures 4, 5:
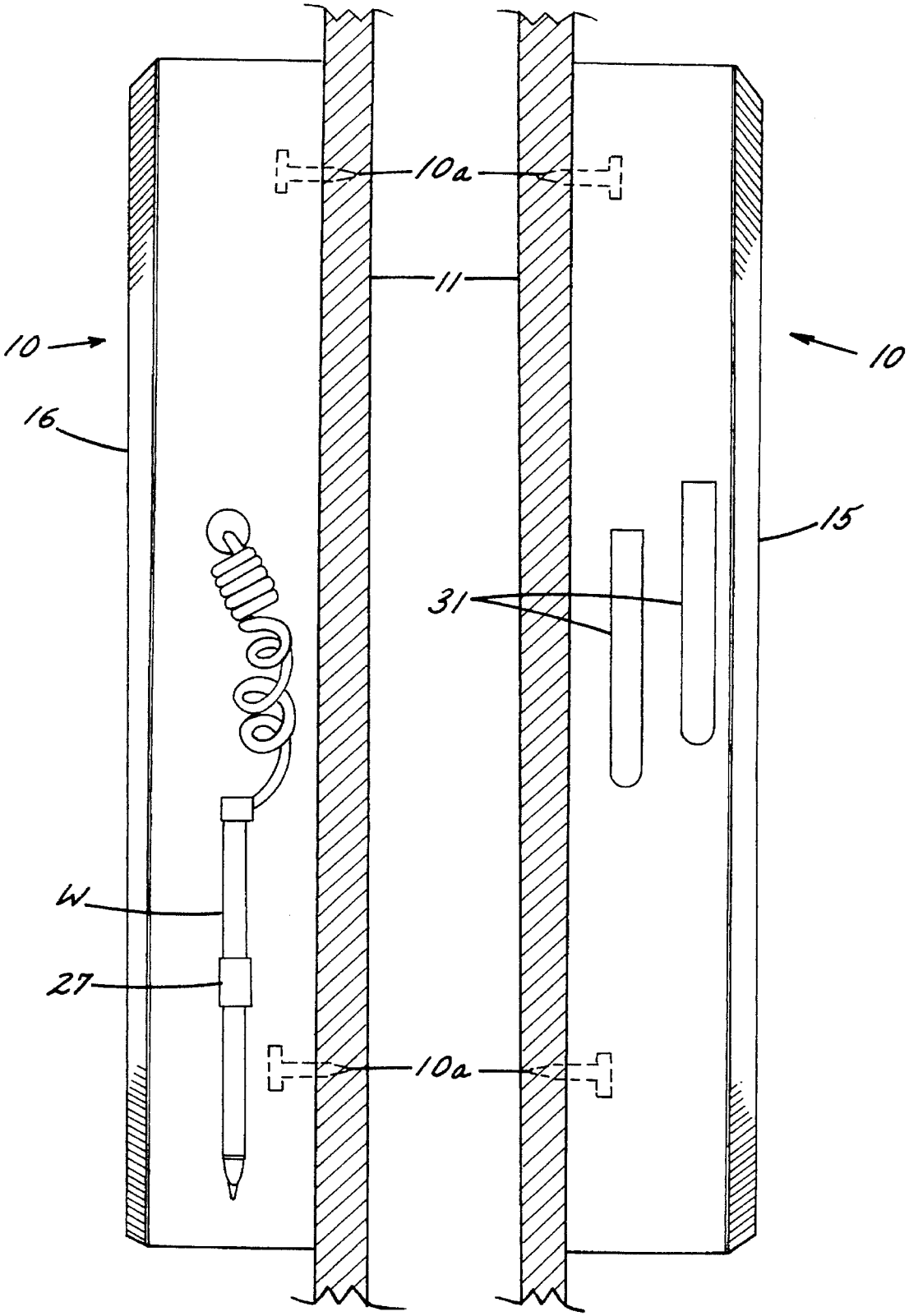
FIG. 4 is a side view of the rack, looking at the right side of FIG. 1.
FIG. 5 is a side view of the rack, looking at the left side of FIG. 1.

Referring more specifically to the drawings, the numeral 10 broadly designates a toilet accessory comprising a storage rack adapted for the temporary storage of personal items in the toilet stalls of public rest rooms and in the bathrooms of homes. The storage rack is attached near a toilet as by screws 10A (FIGS. 4 and 5) fastened to the inside of a door or to a wall indicated at 11 in FIGS. 3 through 8.

The storage rack 10 comprises front and rear walls 13 and 14, side walls 15 and 16, and a bottom wall 17. The interior of the rack is hollow and, preferably, the rack is about twenty four inches long, thirteen inches wide, and three inches deep.

Figure 1:
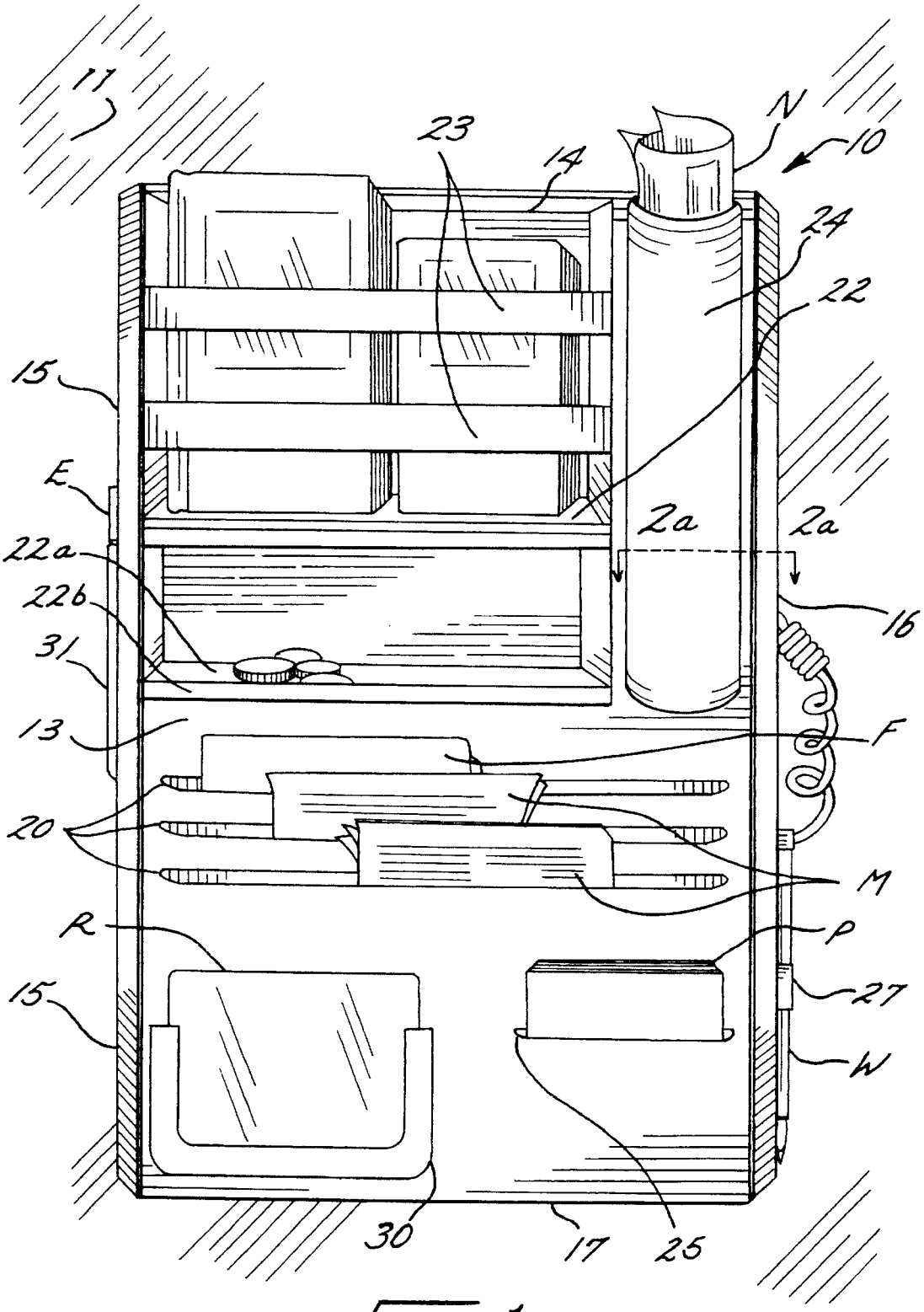
FIG. 1 is front view of one embodiment of the toilet accessory mounted on a door, with parts broken away and showing items in the rack for the purpose of illustration.
Figure 2:
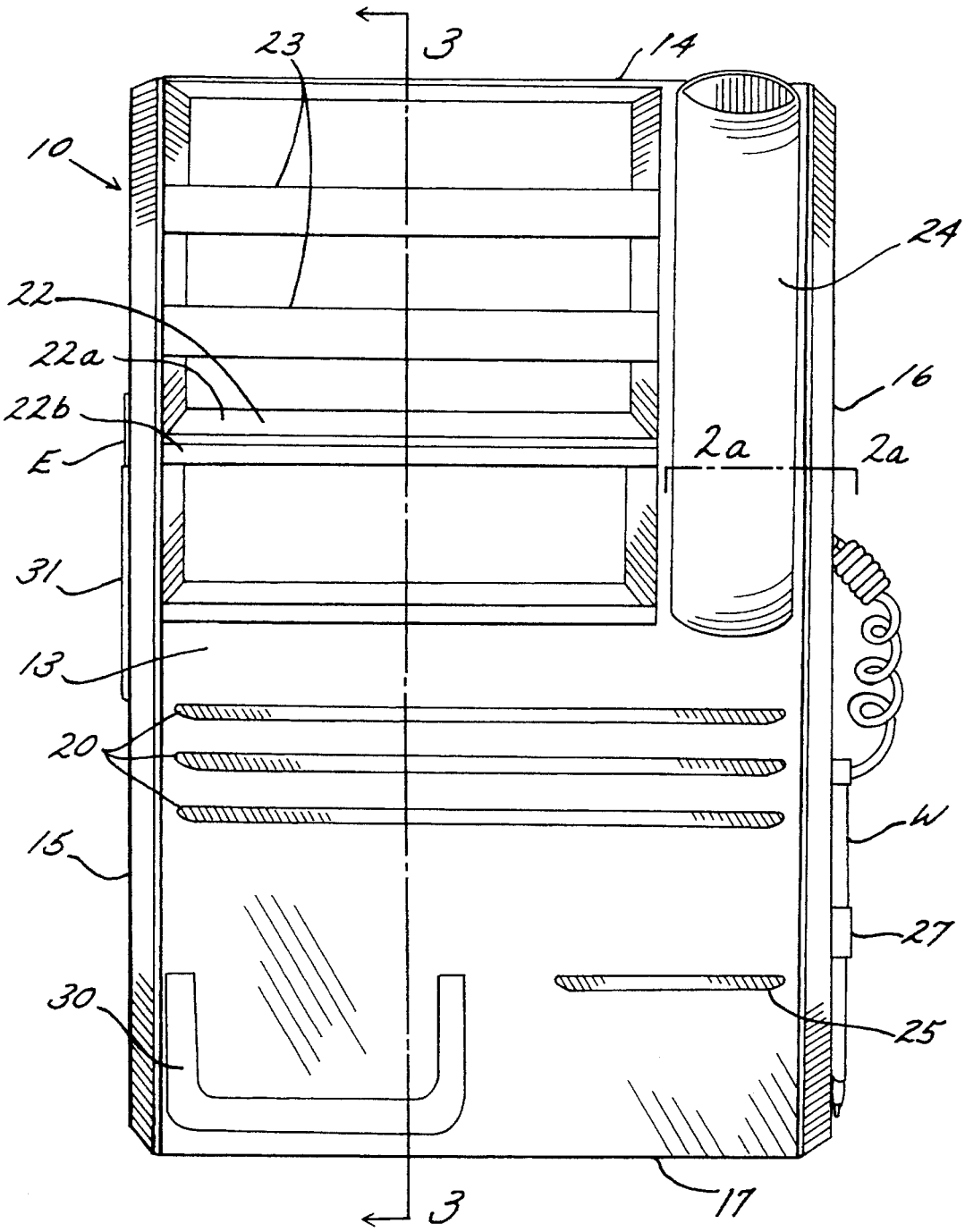
FIG. 2 is a front view of the rack shown in FIG. 1, but omitting the items in the rack.
Figure 2A:
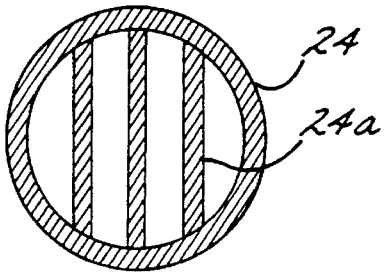
FIG. 2A is a sectional view taken substantially along the line 2A—2A in FIG. 2.
Figure 3:
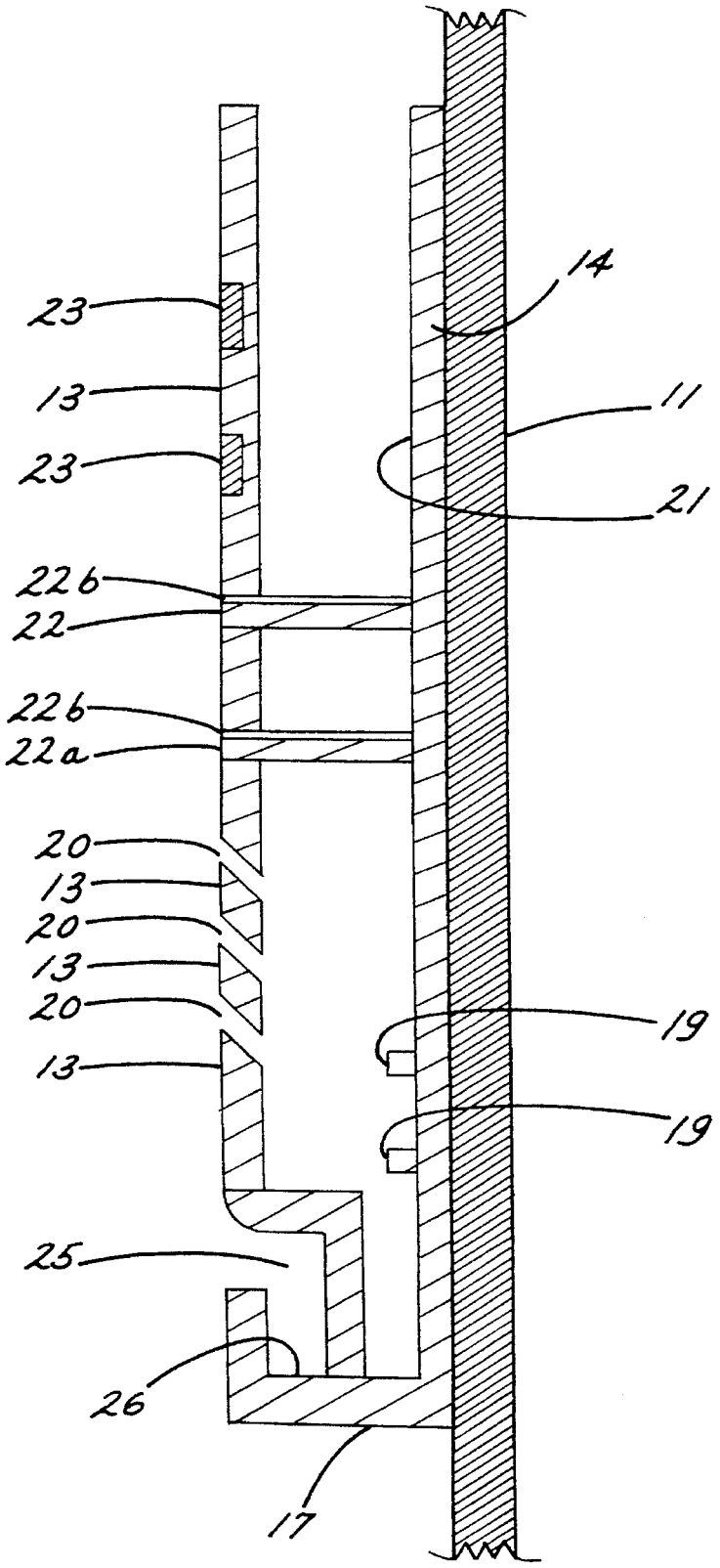
FIG. 3 is a sectional view taken substantially along the line 3—3 in FIG. 2.

The front wall 13 has a plurality of slots or compartments 20, each about three quarters of an inch in width and about eleven inches long, that extend downwardly through the front wall 13 at an angle of about 45° to 60°. Stops 19 (FIG. 3) are fixed to the inner surface 21 of the rear wall 14 beneath the slots 20 to support magazines M, file folders F, and the like that do not exceed the width of the slots, as shown in FIG. 1.

A shelf 22 at the top of the rack 10 supports books B, which are restrained from falling forwardly off the shelf by a pair of slats 23 extending across the rack 10 from its side wall 15 to a cylindrical compartment 24, provided for the temporary storage of a rolled-up newspaper N.

The newspaper compartment 24 is preferably about nine inches long and three inches in diameter. The bottom of compartment 24 is formed by spaced slats 18 which prevents trash from accumulating in the compartment 24.

A second shelf 22A is provided beneath the shelf 22. Shelf 22A is intended to hold any desired-small personal items, such as change C, jewelry, and eye glasses.

A slot 25 in the lower right corner of the rack (FIG. 1) opens into a small compartment 26, preferably about 3.5×3.5 inches (FIG. 3), to accomodate paper P, such as that sold under the trademark POST-IT by Minnesota Mining and Manufacturing Company of St. Paul, Minn. A pen W is suitably supported as by a clip 27 on the side 16 of the rack.

A bracket 30 in the lower left corner of the rack (FIG. 1) removably supports a mirror R that may be removed from the rack for personal use. Pockets 31 on the side wall 15 may support emery boards E and a nail clipper.

Figure 6:
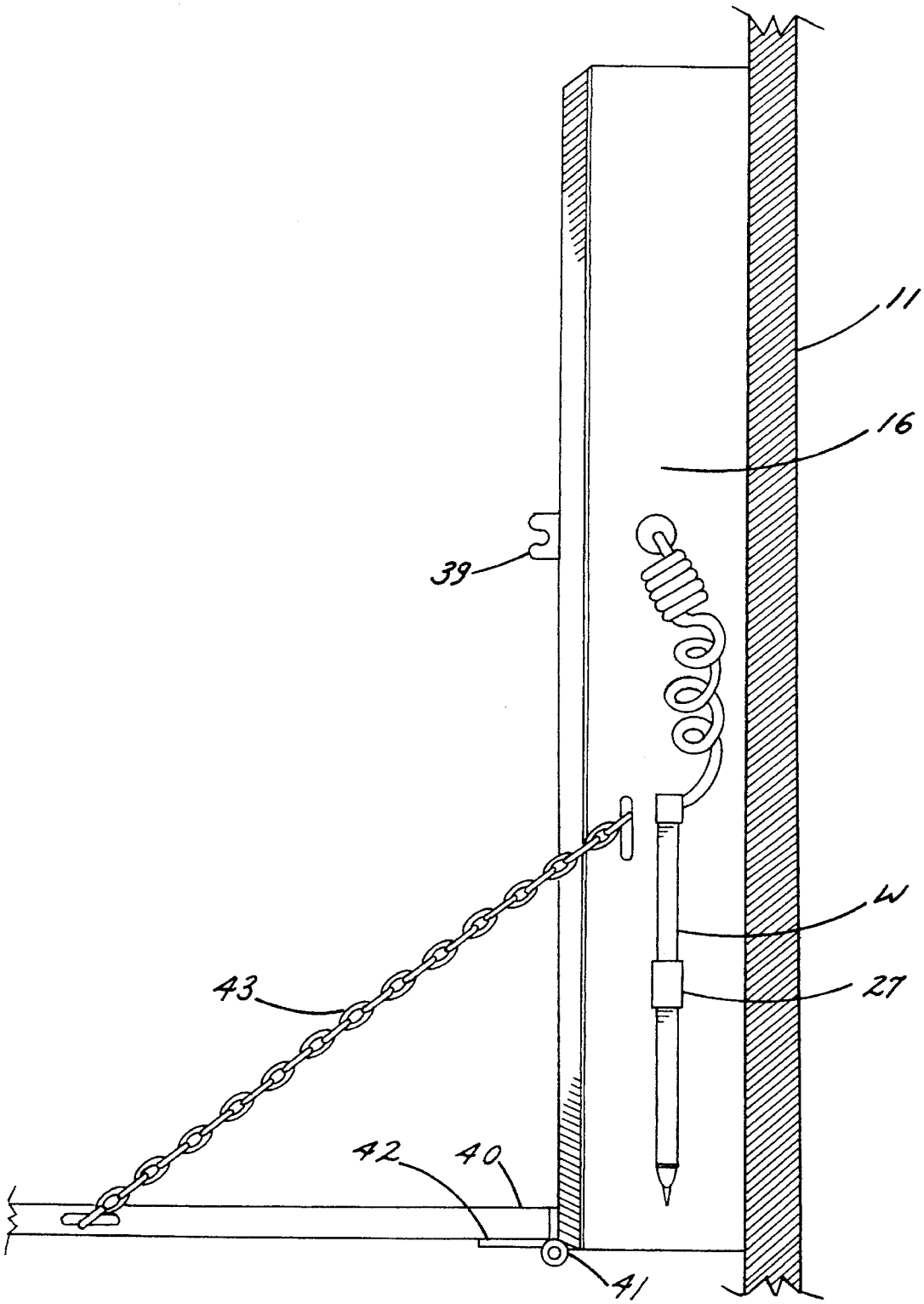
FIG. 6 is a side view of the rack showing a second embodiment of the invention, comprising a drop-down table shown in open position and attached to the rack by chains.
Figure 6A:
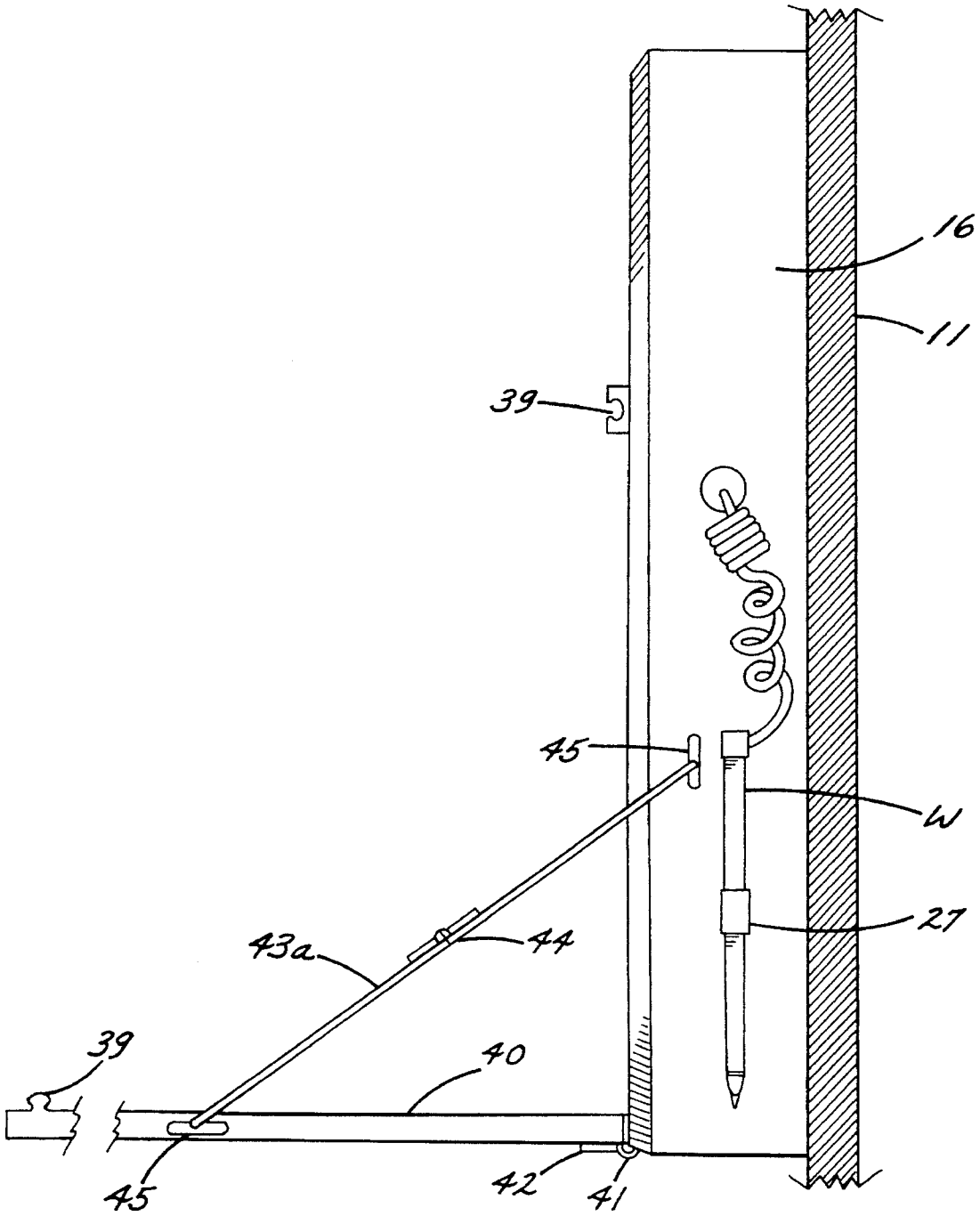
FIG. 6A is a side view of the rack shown in FIG. 6, illustrating an alternate attachment of the table to the rack by hinged arms.
Figure 7:
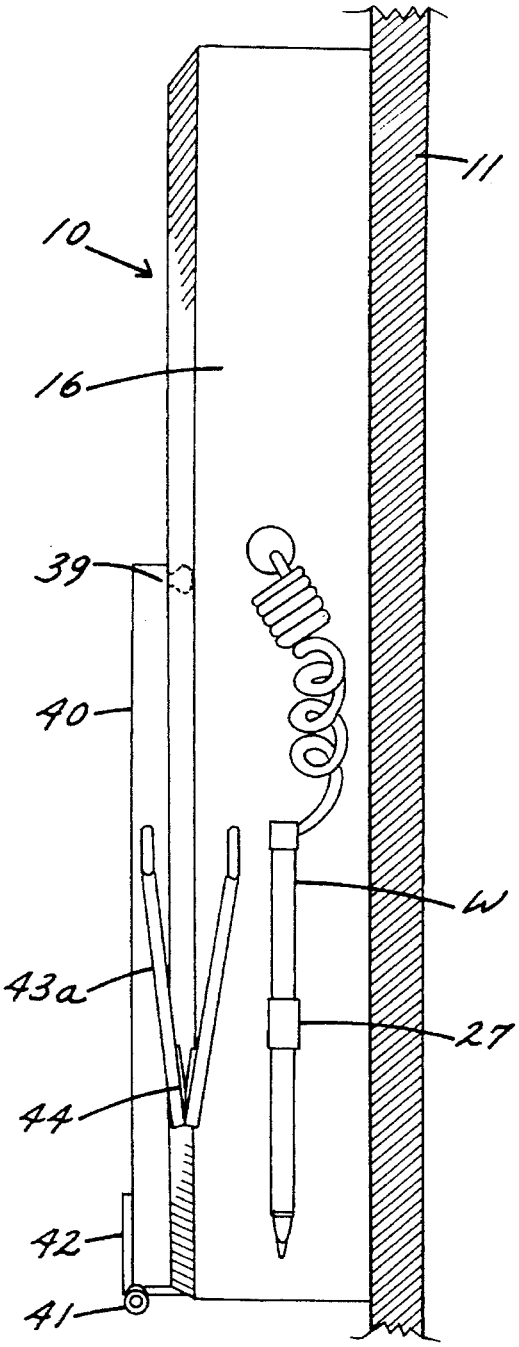
FIG. 7 is another side view of the rack shown in FIG. 6, showing the table in closed position.

FIGS. 6, 6A and 7, illustrate a second embodiment of the invention comprising a table 40, hinged at its lower end 41, as at 42, to the rack 10. The table 40 may be folded outwardly and supported in the usable position of FIG. 6 as by chains 43 (FIG. 6) extending between the table and the sides of the rack. FIG. 6A illustrates an alternate support for the table 40 wherein arms 43A that are hinged as at 44 extend between the table and the rack 10. When not in use, the table 40 is folded upwardly and held, as by a snap fastener 39, in its storage position against the front of the rack 10.

Figure 8:
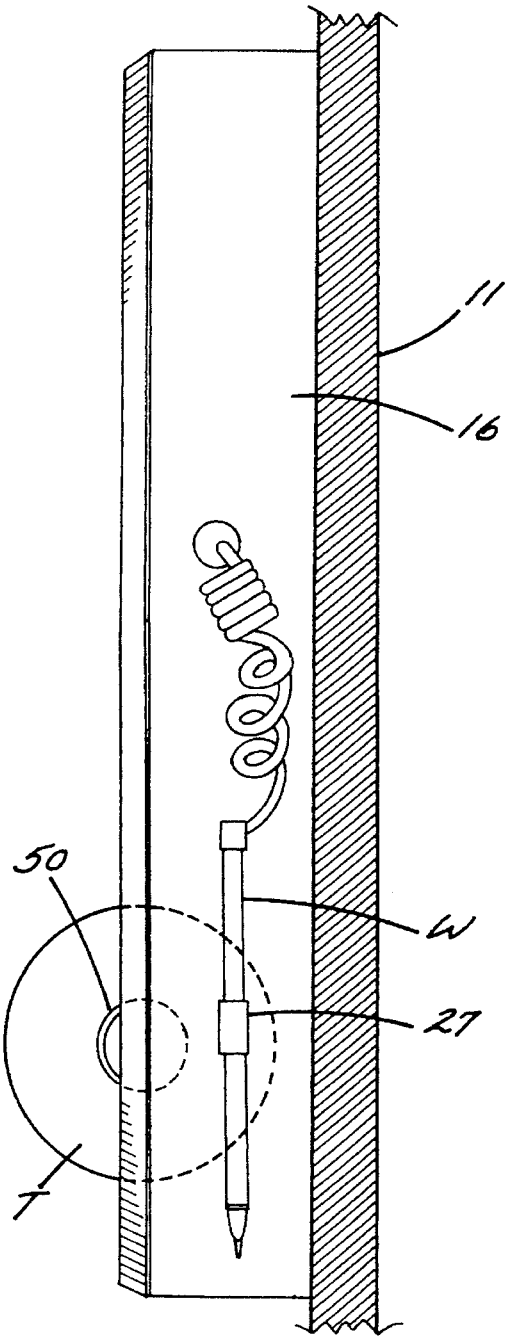
FIG. 8 is a side view of the rack showing a third embodiment of the invention, comprising a toilet paper holder.

FIG. 8 illustrates a third embodiment wherein the rack 10 includes a holder 50 for a roll of toilet paper T.

There is thus provided a storage rack uniquely adapted to safely provide storage, in the privacy of a toilet stall, for a variety of personal items carried into public rest rooms. The rack may also provide amenities, such as note paper, a pen, a mirror, emery boards, and a table for the convenience of successive visitors to the bathroom or stall in a public rest room.

Although specific terms have been used in describing the invention, they have been used in a generic and descriptive sense only, and not for the purpose of limitation, the scope of the invention being determined by the claims when read in conjunction with this specification and the accompanying drawings, and the applicable prior art.

I claim:

1. A storage rack for attachment to a supporting structure, said storage rack comprising a front wall, a rear wall, first and second horizontally spaced side walls, a vertically extending cylindrical compartment between the rear wall and said first side wall, the cylindrical compartment having an open top and being of sufficient inside diameter to receive a rolled-up newspaper, horizontally spaced slats extending across the end of the cylindrical compartment opposite its open top, at least one shelf extending between said second side wall and the cylindrical compartment, at least one slat extending between said second side wall and the cylindrical compartment and above at least one shelf, the front wall having a group of horizontally extending slots extending downwardly through the front wall at an angle between 45° and 60°, a corresponding number of stops fixed to the inner surface of the rear wall beneath the slots, whereby magazines may be supported in the storage rack, a rectangular compartment between the first side wall, the bottom wall and the front wall, the front wall having an access slot communicating with said rectangular compartment, whereby a supply of paper may be placed in the rectangular compartment and accessed through the access slot, a U-shaped bracket extending forwardly from the front wall, whereby a mirror may be supported in the bracket, a writing instrument attached to the outer surface of one of the side walls, pockets on the outer surface of one of the walls, whereby emery boards and nail clippers may be supported on the storage rack, a table hinged to the lower edge of the front wall, means supporting the table in an operable position in right angular relation to the storage rack, means for supporting the table in an inoperable position in parallel relation to the storage rack, a toilet paper holder journaled on the storage rack, and means for attaching the storage rack to the supporting structure.

2. A storage rack for attachment to a supporting structure, said storage rack comprising a front wall, a rear wall, first and second horizontally spaced side walls, a vertically extending cylindrical compartment between the rear wall and said first side wall, the cylindrical compartment having an open top and being of sufficient inside diameter to receive a rolled-up newspaper, horizontally spaced slats extending across the end of the cylindrical compartment opposite its open top, and means for attaching the storage rack to the supporting structure.

3. A storage rack for attachment to a supporting structure, said storage rack comprising a front wall, a rear wall, first and second horizontally spaced side walls, a vertically extending cylindrical compartment between the rear wall and said first side wall, the cylindrical compartment having an open top and being of sufficient inside diameter to receive a rolled-up newspaper, at least one shelf extending between said second side wall and the cylindrical compartment, at least one slat extending between said second side wall and the cylindrical compartment and above at least one shelf, and means for attaching the storage rack to the supporting structure.

4. A storage rack for attachment to a supporting structure, said storage rack comprising a front wall, a rear wall, first and second horizontally spaced side walls, a vertically extending cylindrical compartment between the rear wall and said first side wall, the cylindrical compartment having an open top and being of sufficient inside diameter to receive a rolled-up newspaper, the front wall having a group of horizontally extending slots extending downwardly through the front wall at an angle between 45° and 60°, and a corresponding number of stops fixed to the inner surface of the rear wall beneath the slots, whereby magazines may be supported in the storage rack, and means for attaching the storage rack to the supporting structure.

5. A storage rack for attachment to a supporting structure, said storage rack comprising a front wall, a rear wall, first and second horizontally spaced side walls and a bottom wall, a vertically extending cylindrical compartment between the rear wall and said first side wall, the cylindrical compartment having an open top and being of sufficient inside diameter to receive a rolled-up newspaper, a rectangular compartment located between the first side wall, the bottom wall and the front wall, and the front wall having an access slot communicating with said rectangular compartment, whereby a supply of paper may be placed in the rectangular compartment and accessed through the access slot, and means for attaching the storage rack to the supporting structure.

6. A storage rack for attachment to a supporting structure, said storage rack comprising a front wall, a rear wall, first and second horizontally spaced side walls, a vertically extending cylindrical compartment between the rear wall and said first side wall, the cylindrical compartment having an open top and being of sufficient inside diameter to receive a rolled-up newspaper, a U-shaped bracket extending forwardly from the front wall, whereby a mirror may be supported in the bracket, and means for attaching the storage rack to the supporting structure.

7. A storage rack for attachment to a supporting structure, said storage rack comprising a front wall, a rear wall, first and second horizontally spaced side walls, a vertically extending cylindrical compartment between the rear wall and said first side wall, the cylindrical compartment having an open top and being of sufficient inside diameter to receive a rolled-up newspaper, a writing instrument attached to the outer surface of one of the side walls, and means for attaching the storage rack to the supporting structure.

8. A storage rack for attachment to a supporting structure, said storage rack comprising a front wall, a rear wall, first and second horizontally spaced side walls, a vertically extending cylindrical compartment between the rear wall and said first side wall, the cylindrical compartment having an open top and being of sufficient inside diameter to receive a rolled-up newspaper, pockets on the outer surface of one of the walls, whereby emery boards and nail clippers may be supported in the pockets, and means for attaching the storage rack to the supporting structure.

* * * * *